US006853351B1

(12) United States Patent
Mohuchy

(10) Patent No.: US 6,853,351 B1
(45) Date of Patent: Feb. 8, 2005

(54) COMPACT HIGH-POWER REFLECTIVE-CAVITY BACKED SPIRAL ANTENNA

(75) Inventor: Wolodymyr Mohuchy, Nutley, NJ (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 10/323,261

(22) Filed: Dec. 19, 2002

(51) Int. Cl.[7] ..... H01Q 1/380; H01Q 11/080
(52) U.S. Cl. ..... 343/895; 343/754; 343/700 MS
(58) Field of Search ..... 343/895, 854, 343/806, 792.5, 700 MS, 797, 720, 754, 824, 846

(56) References Cited

U.S. PATENT DOCUMENTS 3,949,407 A * 4/1976 Jagdmann et al. ..... 343/895
3,956,752 A * 5/1976 Phelan et al. ..... 343/754
4,087,821 A * 5/1978 Phelan ..... 343/754
4,431,998 A * 2/1984 Finken ..... 343/797
4,658,262 A * 4/1987 DuHamel ..... 343/792.5
H000605 H * 3/1989 Finken ..... 343/853
5,212,494 A * 5/1993 Hofer et al. ..... 343/859
5,313,216 A * 5/1994 Wang et al. ..... 343/700 MS
5,331,453 A * 7/1994 Lipsky ..... 398/204
5,453,752 A * 9/1995 Wang et al. ..... 343/700 MS
5,508,710 A 4/1996 Wang et al.
5,589,842 A 12/1996 Wang et al.
5,815,122 A 9/1998 Nurnberger et al.
5,990,849 A 11/1999 Salvail et al.
6,407,721 B1 6/2002 Mehen et al.

* cited by examiner

*Primary Examiner*—Don Wong
*Assistant Examiner*—Chuc Tran
(74) *Attorney, Agent, or Firm*—RatnerPrestia

(57) ABSTRACT

An antenna device includes a substrate, and a radiating element disposed on the substrate. The radiating element has two spiral arms unfurling in an Archimedean progression and terminating in a logarithmic progression. The substrate is formed from a dielectric material and includes multiple perforations for providing passage of coolant through the substrate. The radiating element is disposed on a front surface of the substrate, and an enclosure is formed on a rear surface of the substrate to provide a reflective cavity for reflecting radiation to the front surface of the substrate. The enclosure includes a hexagonal perimeter formed by a wall. The antenna device may be used as an element in a planar phased array.

14 Claims, 6 Drawing Sheets

COMPACT HIGH-POWER REFLECTIVE-CAVITY BACKED SPIRAL ANTENNA

FIELD OF THE INVENTION

The present invention relates, in general, to antennas and, more specifically, to reflective-cavity backed spiral antennas, operating over a broad frequency range, that may be used as stand-alone radiators or as modular components of phased arrays.

BACKGROUND OF THE INVENTION

Spiral antenna devices are used in a myriad of applications requiring broad frequency coverage. These devices typically include patch or microstrip antennas having Archimedean, logarithmic, equiangular, sinuous or multi-arm planar configurations, as described in U.S. Pat. No. 5,508,710, issued Apr. 16, 1996 to Wang et al. In general, antenna elements are disposed on dielectric substrates, which radiate outwardly from both sides of the substrate.

A cavity is placed on one side of the substrate to trap or absorb radiation in an unwanted direction. The trapped radiation or energy must be either terminated or recombined with radiation in a desired direction, so that a resulting radiation pattern is not adversely affected.

A cavity having a depth of a quarter wavelength ($\lambda/4$) may combine two wavefronts in phase. The ability to combine these wavefronts is dependent on the relative phase between the direct and the reflected components of the wavefronts. Since combining these wavefronts is frequency dependent, the antenna device results in a narrow-band device. In practice, the cavity is absorber-loaded to mask the reflective cavity back wall and eliminate unwanted signals from interfering with a desired radiation pattern. Under these circumstances, the spiral antenna device dissipates half the signal and is primarily used in receivers, which are limited to low power.

U.S. Pat. No. 5,815,122 (issued on Sep. 29, 1998 to Nurnberger et al.), U.S. Pat. No. 5,589,842 (issued on Dec. 31, 1996 to Wang et al.), and U.S. Pat. No. 6,407,721 (issued on Jun. 18, 2002 to Mehen et al) disclose ways of eliminating the $\lambda/4$ cavity depth in an attempt to provide thin conformal radiators. Eliminating the $\lambda/4$ cavity depth is of particular is interest at UHF/VHF frequencies, where cavity depths are measured in feet and are impractical for deployment on airborne platforms. Cavity depths of one hundredth of a wavelength ($\lambda/100$) are disclosed to achieve thin conformal devices. These devices, however, are limited to low power receiving applications.

In addition to dissipating at least half the power, another limitation on the power capacity of a spiral antenna is its RF feed network, known as a balun. The balun is a component providing excitation to the spiral antenna. The balun is typically placed in transmission lines carrying low power and, if placed in a cavity that is not highly absorptive, generates multiple cavity resonances.

A need exists for an antenna that is suitable not only for broadband receiving functions, but also suitable for transmitting functions that can sustain high peak and average power. A need also exists for alternate means of feeding antenna terminals that eliminates the balun, because the balun is power limited.

A need further exists for a spiral antenna suitable for use in broadband phased arrays, and suitable in modular construction of such phased arrays.

Yet another need exists for a spiral antenna device whose depth is small, permits conformal installation, and when used in high power applications includes efficient cooling means.

This invention addresses these needs.

SUMMARY OF THE INVENTION

To meet this and other needs, and in view of its purposes, the present invention provides an antenna device comprising a substrate, and a radiating element disposed on the substrate. The radiating element includes two spiral arms unfurling in an Archimedean progression and terminating in a logarithmic progression. Each of the spiral arms are formed from one of (a) a metallic clad material for low power transmissions and (b) a conductor of solid metal for high power transmissions.

In one embodiment of the invention, the substrate is formed from a dielectric material and includes multiple perforations for providing passage of coolant through the substrate. The radiating element is disposed on a front surface of the substrate, and an enclosure is formed on a rear surface of the substrate to provide a reflective cavity for reflecting radiation to the front surface of the substrate. The enclosure includes a wall normally extending from the rear surface of the substrate and terminating at a planar surface parallel to the substrate. A cover plate is positioned on the wall at the planar surface. The enclosure also includes a hexagonal perimeter formed by the wall, and the cover plate includes multiple perforations for providing passage of coolant through the cover plate.

In another embodiment of the invention, the antenna device includes an RF absorber, disposed along an interior surface of the wall, for absorbing RF energy that is scattered within the enclosure. The RF absorber includes a composite material absorber disposed along a length of the logarithmic progression of each of the spiral arms, and the composite material absorber has a width corresponding to a width of the logarithmic progression of each of the spiral arms.

In yet another embodiment of the invention, the antenna device includes a radiating element, and a launcher having parallel conductors and a metallic housing surrounding the parallel conductors. The launcher provides RF excitation to the radiating element. The radiating element includes two spiral arms, each unfurling from a respective RF terminal, and each respective RF terminal is connected to one of the parallel conductors of the launcher. Each of the parallel conductors has a cross sectional diameter, which is separated from the other conductor by a first distance. The metallic housing is separated from each of the parallel conductors by a second distance. The cross sectional diameter, and the first and second distances are determined by power requirements and impedance of the radiating element.

In an embodiment of the invention, ends of the parallel conductors are tapered for facilitating connection to the radiating element. Each of the parallel conductors is coupled between an RF terminal of the radiating element and either a transmitter, a receiver, or a transmitter/receiver.

The invention also includes a phased array that has multiple antenna devices. Each antenna device includes a substrate, a radiating element disposed on a front surface of the substrate, and an enclosure formed on a rear surface of the substrate to provide a reflective cavity for reflecting radiation to the front surface of the substrate. The enclosure also includes a hexagonal wall attached to the substrate. The antenna device further includes a launcher having parallel conductors and a metallic housing surrounding the parallel conductors, where by the launcher provides RF excitation to the radiating element.

The antenna device of the phased array includes multiple perforations in the substrate and the enclosure for providing passage of coolant through the antenna device. A hexagonal wall of one antenna device is removably attached to a hexagonal wall of another antenna device. The multiple antenna devices are abutted, one to another, to form a honeycomb configuration.

It is understood that the foregoing general description and the following detailed description are exemplary, but are not restrictive, of the invention.

BRIEF DESCRIPTION OF THE DRAWING

The invention is best understood from the following detailed description when read in connection with the accompany drawing. Included in the drawing are the following figures.

DETAILED DESCRIPTION OF THE INVENTION

For purposes of clearer description, the invention is described in terms of transmission into free space, commonly referred to as radiation. This does not restrict the invention from performing receiving functions or simultaneous transmit/receive (T/R) functions, since the antenna is reciprocal and provides identical characteristics in both modes of operation.

Figure 1:
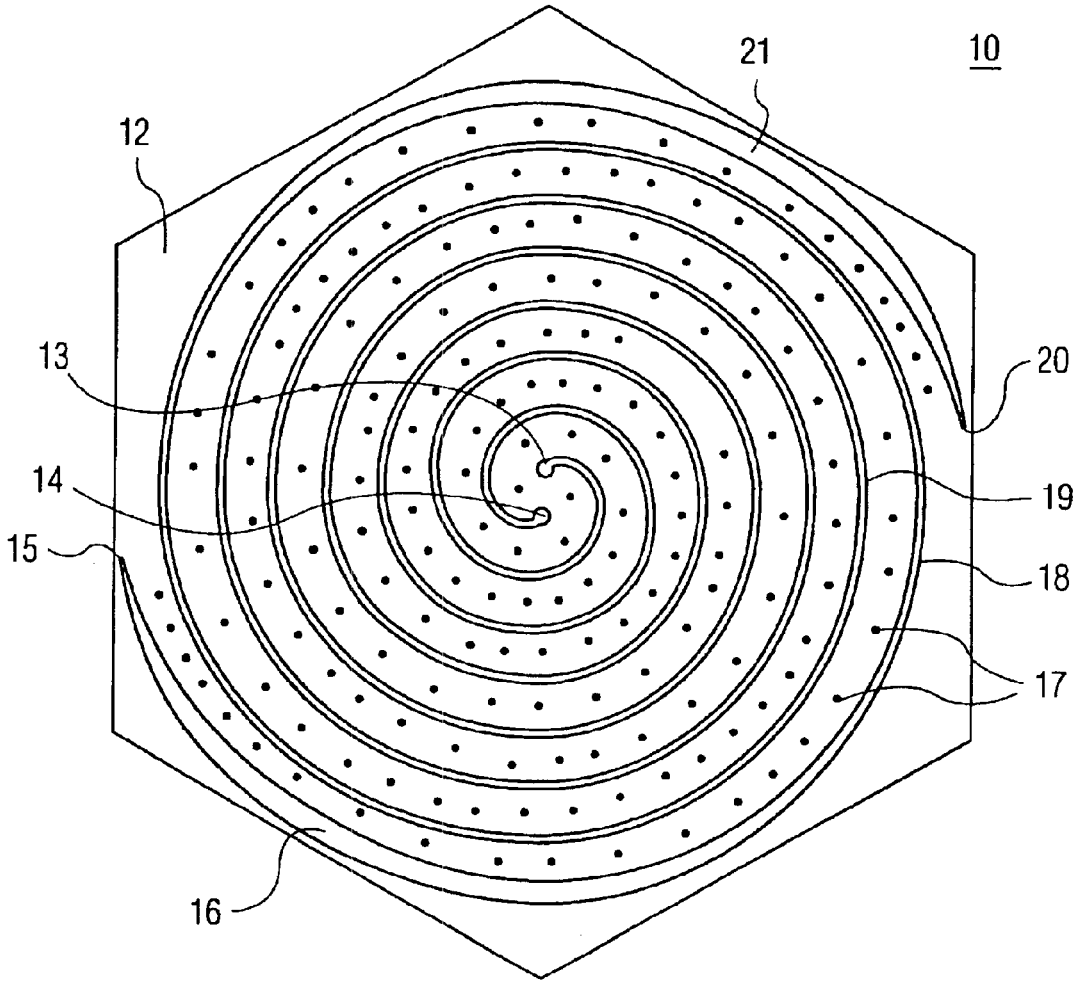
FIG. 1 is a front view of an antenna device showing a radiating element, including two spiral arms, in accordance with an embodiment of the invention.
Figure 2:
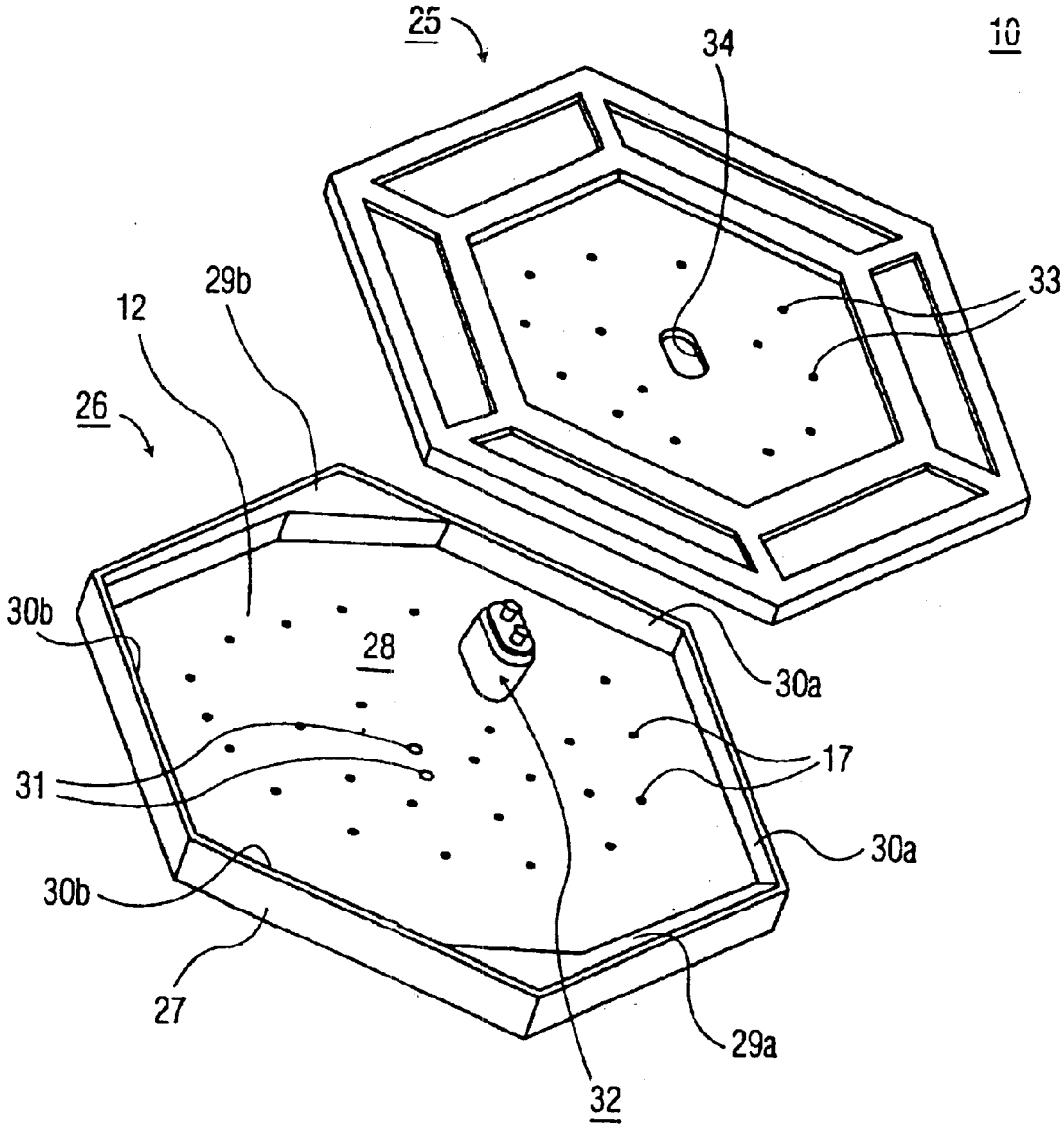
FIG. 2 is an exploded perspective view of an antenna device illustrating a reflective cavity formed therein, in accordance with an embodiment of the invention.

Referring now to the figures, wherein like references refer to like elements of the invention, a compact high-power reflective-cavity backed spiral antenna device is illustrated in FIGS. 1 and 2, and is generally designated as 10. As shown, antenna device 10 includes support structure 26 having substrate 12 mounted on hexagonal wall 27 at one end and cover 25 mounted on hexagonal wall 27 at another end. The spiral pattern of the antenna cannot be seen perspectively in FIG. 2 and is seen in FIG. 1. When cover 25 is seated on support structure 26, enclosed cavity 28 is formed.

Referring to FIG. 1, substrate 12 includes a radiating element having two spiral arms, each arm unfurling from RF input terminals 13 and 14, respectively. Specifically, a first spiral arm includes an Archimedean progression 18 which unfurls from input terminal 13, and a second spiral arm includes an Archimedean progression 19 which unfurls from input terminal 14. RF input terminals 13 and 14 are balanced for RF excitation, as described later.

The final ¾ turn of each end portion of both spiral arms unfurls into a logarithmic progression, designated as 16 and 21, respectively. As shown, the final ¾ turn of the first spiral arm slowly widens to a maximum width and then slowly tapers to a minimum width at end point 15. Similarly, the final ¾ turn of the second spiral arm slowly widens to a maximum width and then slowly tapers to a minimum width at end point 20. It will be appreciated that each logarithmic progression provides termination, at the final ¾ turn of the spiral arm, for absorbing RF material disposed along hexagonal wall 27 of FIG. 2, as described later.

The inventor has discovered that the logarithmic progressions at the end portions of the first and second spirals are advantageous for achieving better RF terminations. Currents flowing in the final ¾ turns of the spiral arms are more evenly distributed over wider portions of the conductor strips. Reflections from these wider portions are more evenly absorbed by RF absorbing materials disposed in the cavity of the device. The final 3 turns of the spiral arms, if not properly terminated, cause interference with the desired radiation pattern of the antenna device.

Overall size of a spiral arm is governed by established rules for efficient radiation. When the device is deployed in a phased array, however, size limitation ensues from grating lobe constraints. The spiral arm is fabricated from a conductive material, having properties determined by power requirements of the antenna device. At moderate power: levels, metallically clad dielectric may be used for the spiral arm, while at high power levels solid metal conductors may be used.

The support structure for the first and second spiral arms (collectively referred to as the spiral antenna or the radiating element) is substrate 12, which is comprised of dielectric material. Substrate 12 includes multiple perforations 17 for providing airflow through the substrate for cooling operation. Perforations 17 may be evenly distributed on substrate 12, in a non-interfering manner with the conductive strips of the radiating element.

It will be appreciated that, while FIG. 1 depicts a radiating element having Archimedean progressions, other spiral configurations may be used, such as sinuous, four square or multi-arm configurations. The end portions of the spiral configurations are widened, however, such as in a logarithmic progression, to provide better RF terminations for the configuration.

Referring now to FIG. 2, the backside of substrate 12 is shown, including perforations 17 for cooling operation. Disposed in cavity 28 and abutting hexagonal wall 27 are RF absorbers 29*a* and 29*b*. RF absorbers 29*a* and 29*b* are also disposed underneath, alongside the length of the final turns of the first and second spirals (e.g. the logarithmic progression portions). These RF absorbers provide RF terminations to absorb residual currents flowing in the radiating element.

Figure 6:
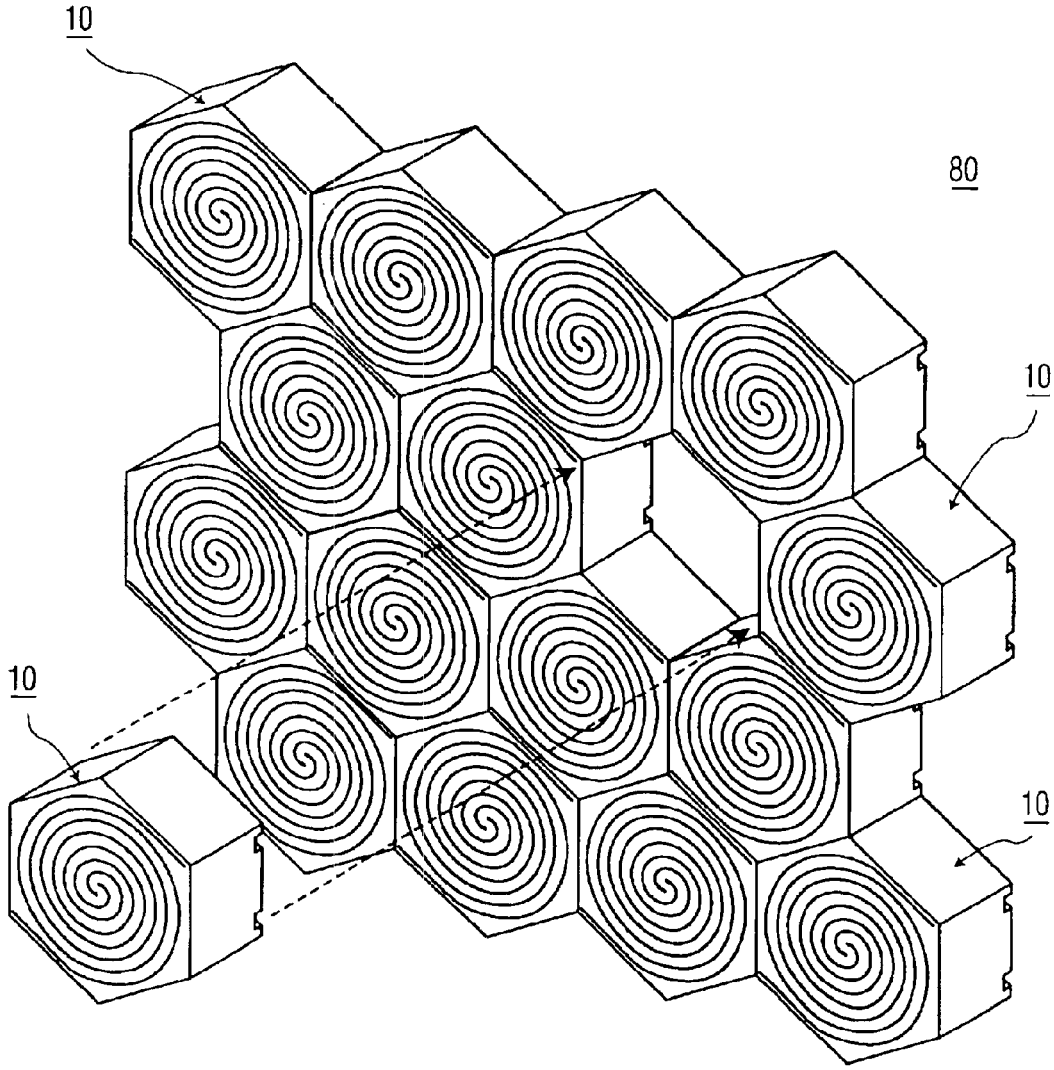
FIG. 6 is a perspective view of a planar phased array illustrating multiple antenna devices arranged in a honeycomb configuration, in accordance with an embodiment of the invention.

The width and length of RF absorbers 29*a* and 29*b* depend on the amount of residual currents flowing in the radiating element. When spiral antenna device 10 is used as a standalone device, the residual currents are low and RF absorbers 29*a* and 29*b* may be simple rectangular bars. When device 10 is used in a wide-scanning phased array (as shown in FIG. 6), however, the low end of the frequency band is not optimized for efficient radiation and may, consequently, produce significant residual currents. These currents may be absorbed by carefully tapering the width of the RF absorbers along the length of the logarithmic progressions of each arm of the spiral antenna. In this manner, tight coupling is provided between the RF absorber and the length of the logarithmic progression of each arm for absorbing the unwanted energy produced by the spiral antenna.

Additional RF absorbers may be provided along the remaining inside portions of hexagonal wall 27, as shown by additional RF absorbers 30*a* and 30*b*. These RF absorbers provide additional protection against residual trapped energy, resulting from manufacturing tolerances, by advantageously absorbing this trapped energy.

It will be appreciated that the RF absorbers shown in FIG. 2 may be formed from composite materials known in the art.

Cover 25 is an integral part of support structure 26 and is shown as a separate portion, in order to expose the interior components included in cavity 28. These interior components are the multiple RF absorbers and launcher 32 (described below). Oval cutout 34 in cover 25 provides clearance for launcher 32. Cover 25 also includes perforations 33, similar to perforations 17 formed on substrate 12. By way of perforations 17 and 33, air may flow and completely pass through spiral antenna device 10, thereby providing air passages for cooling operation. Cover 25 may be attached to support structure 26 by use of screws or glue.

Figure 7:
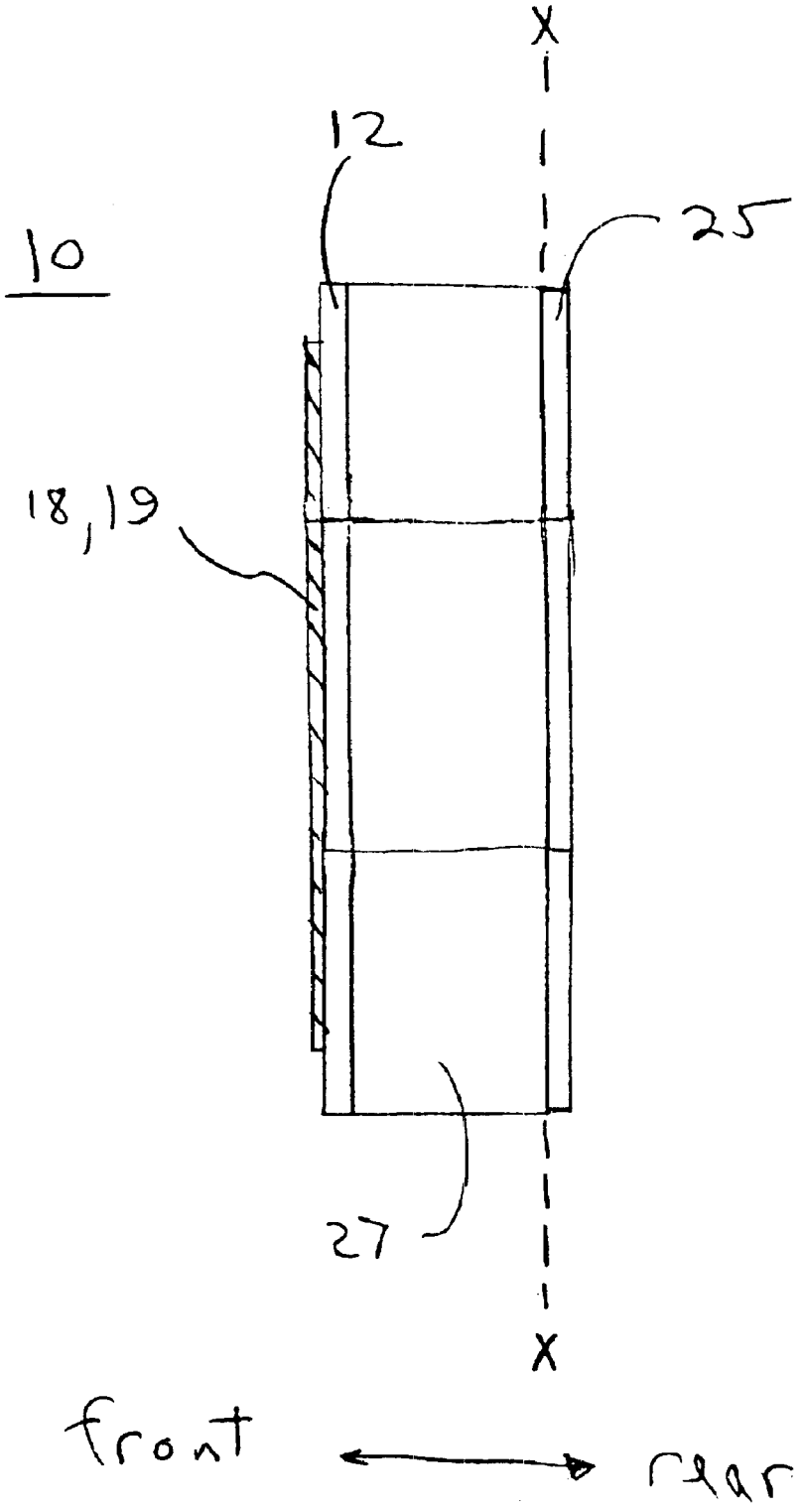
FIG. 7 is a side view of the antenna device shown in FIG. 2 with the cover seated on the support structure, in accordance with an embodiment of the invention.

FIG. 7 is a side view of device 10 shown in FIG. 2. As shown in FIG. 7, hexagonal wall 27 is positioned between substrate 12 and cover 25. Spiral arms 18, 19 are disposed on front of substrate 12. Cover 25 is disposed to the rear of substrate 12. As also shown in FIG. 7, hexagonal wall 27 extends normally from the rear surface of substrate 12 and terminates at planar surface X—X which is parallel to substrate 12. Cover plate 25 is positioned on wall 27 at planar surface X—X.

Figure 3:
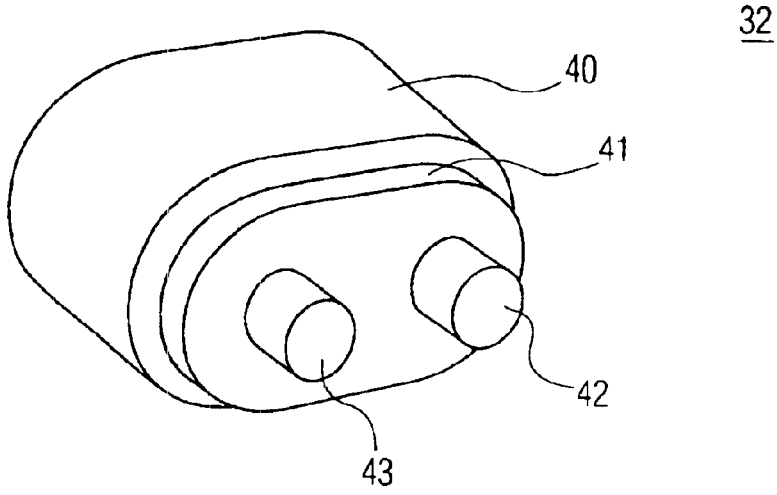
FIG. 3 is a perspective view of a RF launcher illustrating a metallic housing including two parallel conductors, in accordance with an embodiment of the invention.
Figure 4:
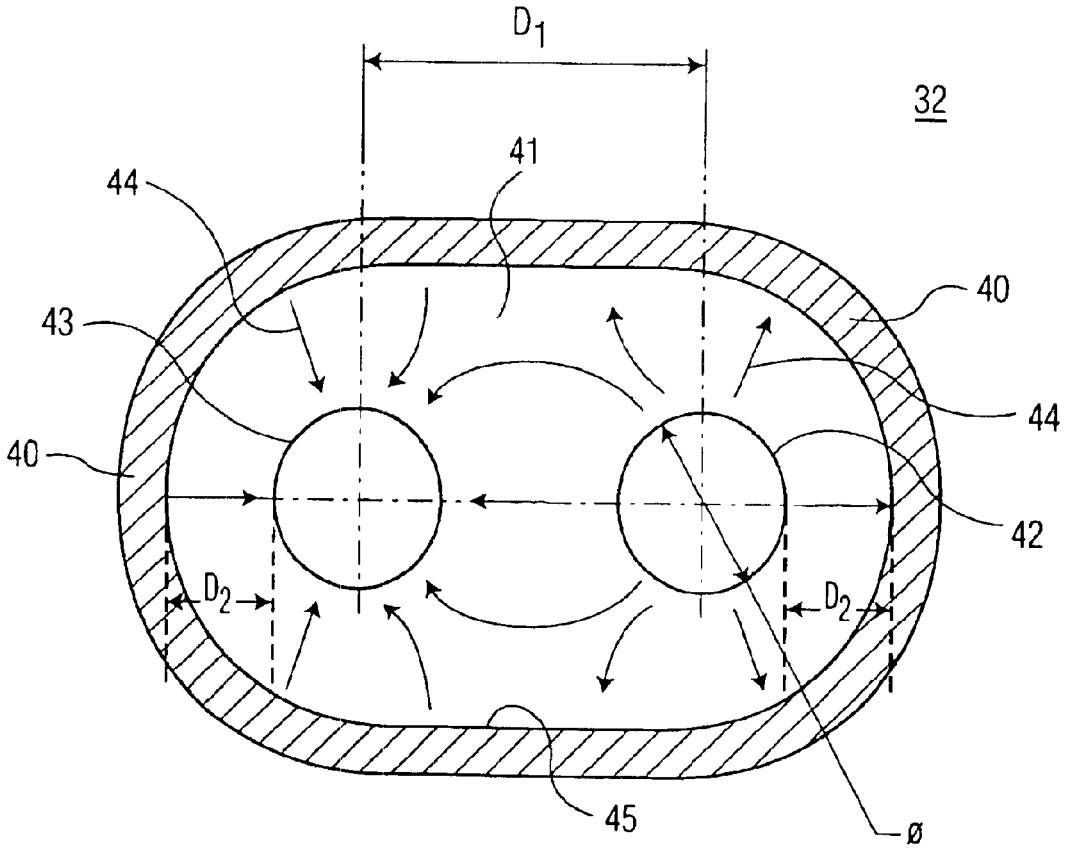
FIG. 4 is a cross sectional view of the RF launcher of FIG. 3, in accordance with an embodiment of the invention.

Turning next to FIGS. 3 and 4, launcher 32 will now be described. Launcher 32 is a twin-wire transmission line including parallel conductors 42 and 43 that connect to RF input terminals 13 and 14 (FIG. 1), by way of through-holes 31 (FIG. 2). Parallel conductors 42 and 43 are enclosed within metallic housing 40. As shown, dielectric support 41 surrounds parallel conductors 42 and 43. It will be understood, however, that dielectric support 41 is optional and may be omitted.

The overall dimensions of launcher 32, particularly of the parallel conductors, are based on the required power capacity. For very high power applications, the conductors may be solid bars and may be attached to RF input terminals 13 and 14 via screws. Metallic housing 40 provides an outer conductor to act as an electrical shield and prevent coupling of propagated RF transmissions into cavity 28, which may cause radiation pattern distortions and cavity resonance.

The launcher may be tapered to accommodate mechanical needs. That is, the parallel conductors, that are parallel to each other at an end remote from the antenna cavity, may slowly converge toward each other so that they may be connected to RF input terminals 13 and 14 of the radiating element.

The E-field distribution within the RF launcher is shown in FIG. 4. The E-field distribution, generally designated as 44, is similar to that of a balanced transmission line that propagates in a TEM mode. On an instantaneous basis, conductor 43 may be viewed as having a positive polarity and conductor 42 may be viewed as having a negative polarity. This instantaneous relationship between the conductors produces the electric field excitation at RF input terminals 13 and 14. The electric field excitation may be achieved by introducing a 180-degree phase shift in one of the input feed lines to conductors 42 and 43, as described below with respect to FIG. 5.

The impedance of the parallel conductors may be determined by known formulas that relate the diameters (φ) of the parallel conductors, their relative distance ($D_1$) from each other, and their relative distance ($D_2$) from inside wall 45 of metallic housing 40. The dielectric constant of the material forming dielectric support 41 within metallic housing 40 may also be determined in a known manner.

It will also be appreciated that the RF launcher may be considered part of a tuning network of spiral antenna device 10 and, as such, may be adjusted through material selections, and component spacings and dimensions to achieve the best broadband impedance match for the radiating element.

Figure 5A:
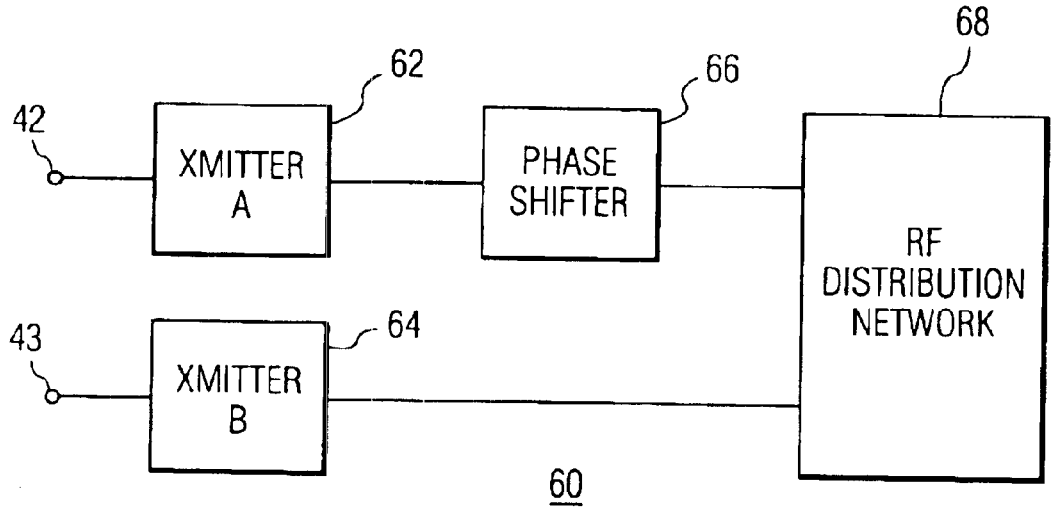
FIGS. 5A and 5B are block diagrams depicting connections between a RF launcher and a transmitting and/or receiving network, in accordance with an embodiment of the invention.
Figure 5B:
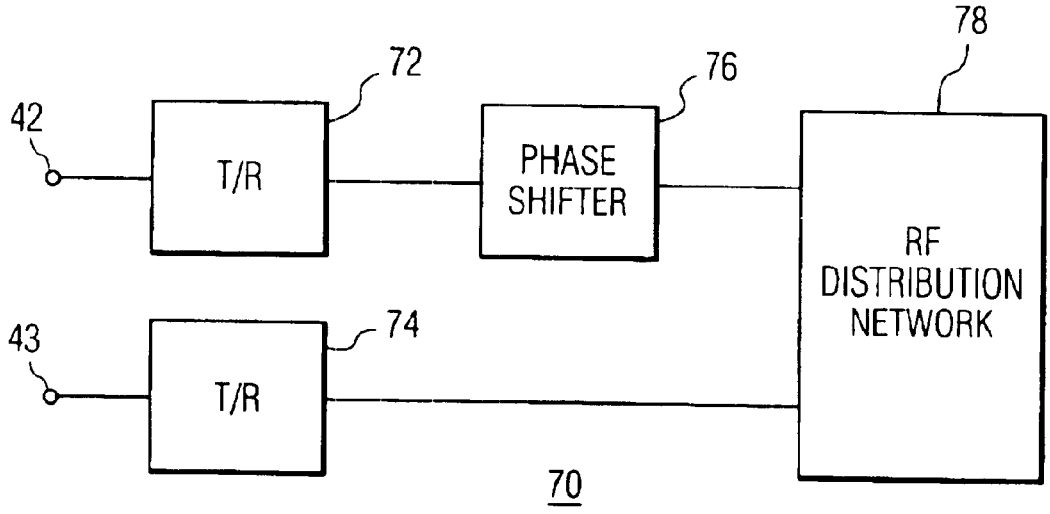

Exemplary system networks that may be connected to RF launcher 32 at conductors 42 and 43 are shown in FIGS. 5A and 5B. As shown, network 60 includes transmitter A 62 and transmitter B 64 having respective transmitter output lines connected to conductors 42 and 43. Phase shifter 66 is included between transmitter A 62 and RF distribution network 68. Transmitter B 64, on the other hand, is directly coupled to RF distribution network 68.

Phase shifter 66 provides a 180° phase shift to the signal at conductor 42 relative to the signal at conductor 43. This 180° phase shift is provided to RF input terminals 13 and 14 of the radiating element by way of RF launcher 32. When the phase shift between the two signals is 180° relative to each other, a voltage is developed across terminals 13 and 14, causing the spiral antenna to radiate in a first mode (n=1), which produces a single beam pattern. Other mode patterns may also be generated depending upon the phase shift produced by phase shifter 66. It will be appreciated that for received signals the process is reversed.

Phase shifter 66 may be placed between RF distribution network 66 and transmitter 62 and, consequently, may be formed from a low power component. As a low power component, phase shifter 66 is easier to implement than a high power component. It also has an insertion loss (which may be appreciable in some MMIC circuits) that is recoverable through the gain of transmitter 62.

Another exemplary embodiment of a network is shown in FIG. 5B, which is similar to the embodiment shown in FIG. 5A. As shown, network 70 includes transmitter/receiver (T/R) 72, T/R 74, phase shifter 76 and RF distribution network 78. One end of T/R 72 is connected to conductor 42 and one end of T/R 74 is connected to conductor 43.

Referring lastly to FIG. 6, there is shown a 16-element portion of phased array 80. As shown, each element of the phased array is comprised of an individual high-power reflective-cavity backed spiral antenna device 10. An array of these individual elements may be configured into a variety of shapes by adding or removing an element, as shown in FIG. 6. The manner in which antenna device 10 may be added or removed from the phased array is disclosed in a related U.S. patent application filed concurrently on the same day, by the same inventor, and is incorporated herein by reference.

In an exemplary spiral antenna device 10, operating in the 500 MHz to 2 GHz frequency region, and providing a maximum scan of 45 degrees at 2 GHz, device 10 may have a depth of only 0.5 inches, and a length (measured between opposing flat hexagonal walls of FIG. 2) of 6.9 inches. The parallel conductors of the launcher may be gold plated rods and may be capable of sustaining 100 watts of CW power.

Although illustrated and described herein with reference to certain specific embodiments, the present invention is, nevertheless, not intended to be limited to the details shown. Rather, various modifications may be made in the details within the scope and range of equivalents of the claims and without departing from the spirit of the invention.

What is claimed:

1. An antenna device comprising:

a substrate, a radiating element disposed on the substrate, the radiating element including two spiral arms unfurling in an Archimedean progression and terminating in a logarithmic progression, the radiating element disposed on a front surface of the substrate, and an enclosure formed on a rear surface of the substrate to provide a reflective cavity for reflecting radiation to the front surface of the substrate.

2. The antenna device of claim 1 wherein each of the spiral arms are formed from one of (a) a metallic clad material for low power transmissions and (b) a conductor of solid metal for high power transmissions.

3. The antenna device of claim 1 wherein the substrate is formed from a dielectric material and includes multiple perforations for providing passage of coolant through the substrate.

4. The antenna device of claim 1 wherein the enclosure includes a wall normally extending from the rear surface of the substrate and terminating at a planar surface parallel to the substrate, and a cover plate positioned on the wall at the planar surface.

5. The antenna device of claim 4 wherein the enclosure includes a hexagonal perimeter formed by the wall.

6. The antenna device of claim 4 wherein the cover plate includes multiple perforations for providing passage of coolant through the cover plate.

7. The antenna device of claim 4 wherein an RF absorber is disposed along an interior surface of the wall for absorbing RF energy scattered within the enclosure.

8. The antenna device of claim 7 wherein the RF absorber includes a composite material absorber disposed along a length of the logarithmic progression of each of the spiral arms, and the composite material absorber having a width corresponding to a width of the logarithmic progression of each of the spiral arms.

9. The antenna device of claim 1 further including a launcher having parallel conductors and a metallic housing surrounding the parallel conductors, the launcher providing RF excitation to the radiating element, and each spiral arm of the radiating element coupled to a respective parallel conductor of the launcher.

10. A phased array comprising:

a plurality of antenna devices, each antenna device including a substrate, a radiating element disposed on a front surface of the substrate, and an enclosure formed on a rear surface of the substrate to provide a reflective cavity for reflecting radiation to the front surface of the substrate, wherein the enclosure includes a hexagonal wall attached to the substrate.

11. The phased array of claim 10 wherein the antenna device includes a launcher having parallel conductors and a metallic housing surrounding the parallel conductors, the launcher providing RF excitation to the radiating element.

12. The phased array of claim 10 wherein the antenna device includes multiple perforations in the substrate and the enclosure for providing passage of coolant through the antenna device.

13. The phased array of claim 10 wherein a hexagonal wall of one antenna device is removably attached to a hexagonal wall of another antenna device.

14. The phased array of claim 10 wherein the plurality of antenna devices are abutted one to another to form a honeycomb configuration.

* * * * *